US010008308B1

(12) United States Patent
Dai

(10) Patent No.: US 10,008,308 B1
(45) Date of Patent: Jun. 26, 2018

(54) CABLE

(71) Applicant: LOTES CO., LTD, Keelung (TW)

(72) Inventor: Yong Jun Dai, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days. days.

(21) Appl. No.: 15/802,832

(22) Filed: Nov. 3, 2017

(30) Foreign Application Priority Data

Dec. 2, 2016 (CN) ..... 2016 2 1315395 U

(51) Int. Cl.

| | |
|---|---|
| ***H01B 11/10*** | (2006.01) |
| ***H01B 11/18*** | (2006.01) |
| ***H01B 11/14*** | (2006.01) |
| ***H01B 13/14*** | (2006.01) |
| ***H01B 3/30*** | (2006.01) |

(52) U.S. Cl.
CPC ..... *H01B 11/1066* (2013.01); *H01B 11/1808* (2013.01); *H01B 11/1826* (2013.01); *H01B 11/1839* (2013.01); *H01B 11/1856* (2013.01); *H01B 13/142* (2013.01); *H01B 3/30* (2013.01); *H01B 11/1091* (2013.01)

(58) Field of Classification Search
CPC ..... H01B 11/002; H01B 11/02; H01B 11/08; H01B 11/085; H01B 11/06; H01B 11/1856; H01B 11/10; H01B 11/1008; H01B 11/1016; H01B 7/221; H01B 7/225
See application file for complete search history.

(56) References Cited

U.S. PATENT DOCUMENTS

2009/0260847 A1* 10/2009 Tobben ..... H01B 11/203 174/107

FOREIGN PATENT DOCUMENTS

| | | | |
|---|---|---|---|
| CN | 2556758 | Y | 6/2003 |
| CN | 101116152 | A | 1/2008 |
| CN | 101553885 | A | 10/2009 |
| CN | 201536030 | U | 7/2010 |
| CN | 102237156 | A | 11/2011 |
| CN | 102544784 | A | 7/2012 |
| CN | 104218337 | A | 12/2014 |
| CN | 104871261 | A | 8/2015 |
| CN | 105355286 | A | 2/2016 |
| CN | 105609178 | A | 5/2016 |
| TW | M402484 | | 4/2011 |

* cited by examiner

*Primary Examiner* — Hoa C Nguyen
*Assistant Examiner* — Amol Patel
(74) *Attorney, Agent, or Firm* — Locke Lord LLP; Tim Tingkang Xia, Esq.

(57) ABSTRACT

A cable includes: at least two cores for transmitting signals, a first insulator and a second insulator each wrapping one of the cores, and a shielding sheet. The first insulator has a first surface, the second insulator has a second surface urging against the first surface, and at least parts of the first surface and the second surface are not overlapped. The shielding sheet has a wrapping portion, and a first end portion and a second end portion located on two sides of the wrapping portion. The wrapping portion longitudinally wraps around both the first insulator and the second insulator in the direction parallel to axes of the cores, such that a space is formed between the shielding sheet, the first surface, and the second surface. The first end portion and the second end portion bend and enter the space.

8 Claims, 6 Drawing Sheets

100

CABLE

CROSS-REFERENCE TO RELATED APPLICATIONS

This non-provisional application claims priority to and benefit of, under 35 U.S.C. § 119(a), Patent Application No. 201621315395.5 filed in P.R. China on Dec. 2, 2016, the entire content of which is hereby incorporated by reference.

FIELD OF THE INVENTION

The present invention relates to an electrical cable, and more particular to a high-frequency electrical cable for transmitting high-speed signals.

BACKGROUND OF THE INVENTION

A cable for transmitting high-frequency electric signals exists in the industry. The cable includes a conductor. Each conductor is wrapped by an insulator, and a shielding tape is longitudinally adhered to the insulation material. As shown in the first figure of the specification of Chinese Patent Application No. 200580038312.0, two ends of the shielding tape are overlapped along the longitudinal direction of the conductor, such that the shielding tape covers the conductor by 100%, thereby enhancing the shielding and protection capability of the shielding tape, reducing crosstalk during signal transmission in the conductor, and improving the quality of high-speed signal transmission of the cable. However, overlapping of two ends of the shielding tape causes unevenness of the surface of the cable. When the cable is in use and bent, force applied to the surface of the shielding tape is uneven, such that the shielding tape is crumpled or broken, or even detached from the insulator. Therefore, the crosstalk shielding effect of the shielding tape is reduced and the service life of the cable is shortened.

Therefore, a heretofore unaddressed need exists in the art to address the aforementioned deficiencies and inadequacies.

SUMMARY OF THE INVENTION

In one aspect, the present invention provides an electrical cable having a good shielding property, being easy to bend, having a long service life, and being capable of stably transmitting high-frequency signals.

In certain embodiments, a cable includes at least two cores for transmitting signals, a first insulator and a second insulator each wrapping one of the at least two cores, and a shielding sheet. The first insulator has a first surface, the second insulator has a second surface urging against the first surface, and at least parts of the first surface and the second surface are not overlapped. The shielding sheet has a wrapping portion, and a first end portion and a second end portion that are located on two sides of the wrapping portion. The wrapping portion longitudinally wraps around both the first insulator and the second insulator in the direction parallel to axes of the cores, such that a space is formed between the shielding sheet, the first surface, and the second surface, and the first end portion and the second end portion bend and enter the space.

In certain embodiments, the first end portion includes a first connecting section formed by extending from one side of the wrapping portion and a first bending section formed by bending and extending from a tail end of the first connecting section, the second end portion includes a second connecting section formed by extending from the other side of the wrapping portion and a second bending section formed by bending and extending from a tail end of the second connecting section, and the first bending section and the second bending section enter the space.

In certain embodiments, the first bending section urges against the second bending section.

In certain embodiments, the first bending section and the second bending section bend and extend in directions away from each other in the space, to respectively form a first extending section and a second extending section, and a combination of the first extending section and the second extending section presents an inverted V shape in the extending directions.

In certain embodiments, the first insulator and the second insulator are cylinders having the same size and shape and are arranged parallel to each other, a clearance is provided between the first extending section and the first surface, and a clearance is provided between the second extending section and the second surface.

In certain embodiments, the first bending section and the second bending section are formed by vertically bending downward from tail ends of the first connecting section and the second connecting section, respectively, and the two opposite surfaces of the first bending section and the second bending section are adhered to each other.

In certain embodiments, the shielding sheet is further wrapped around by an insulation jacket, the insulation jacket tightly fits with the wrapping portion, the first connecting section, and the second connecting section, and clearances are provided between the insulation jacket and the first bending section and between the insulation jacket and the second bending section, respectively.

In certain embodiments, the insulation jacket is a transparent plastic membrane.

In certain embodiments, the shielding sheet is a membrane made of copper or aluminum.

In certain embodiments, the shielding sheet has an even thickness.

As compared with the related art, certain embodiments of the present invention have the following beneficial advantages:

The first end portion and the second end portion of the shielding sheet in the cable of this invention bend and enter the space, to avoid overlapping of two side edges of the shielding sheet on its surface, thereby enabling the surface of the shielding sheet to be even, guaranteeing the bending property of the shielding sheet, preventing the shielding sheet from divorcing from the insulators during bending of the cable, enhancing the shielding effect of the shielding sheet, and improving the stability of signal transmission of the cable.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
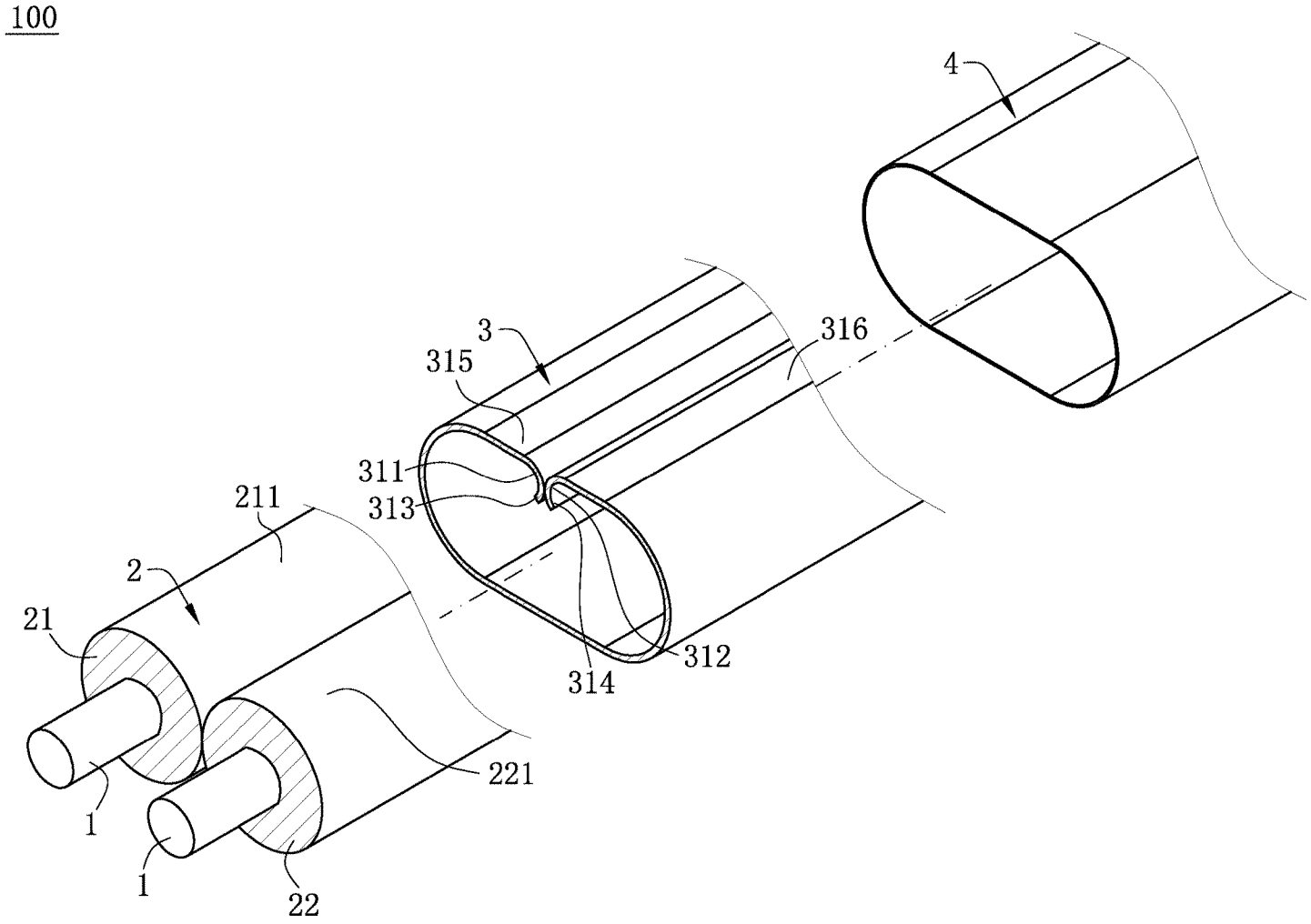
FIG. 1 is a schematic three-dimensional exploded view of a cable according to a first embodiment of the invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to a cable.

Figure 2:
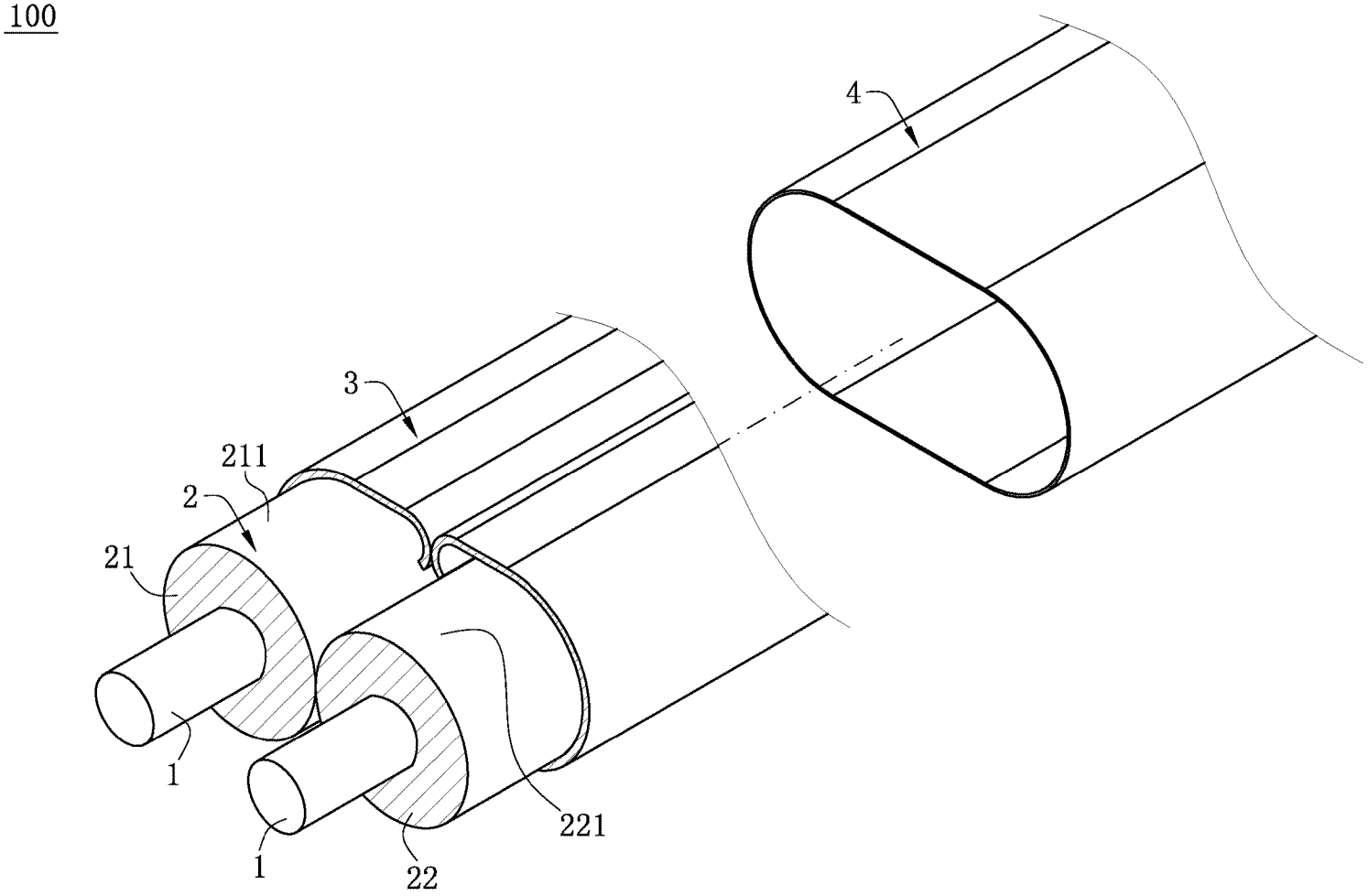
FIG. 2 is a schematic three-dimensional partial exploded view of the cable according to the first embodiment of the invention.
Figure 3:
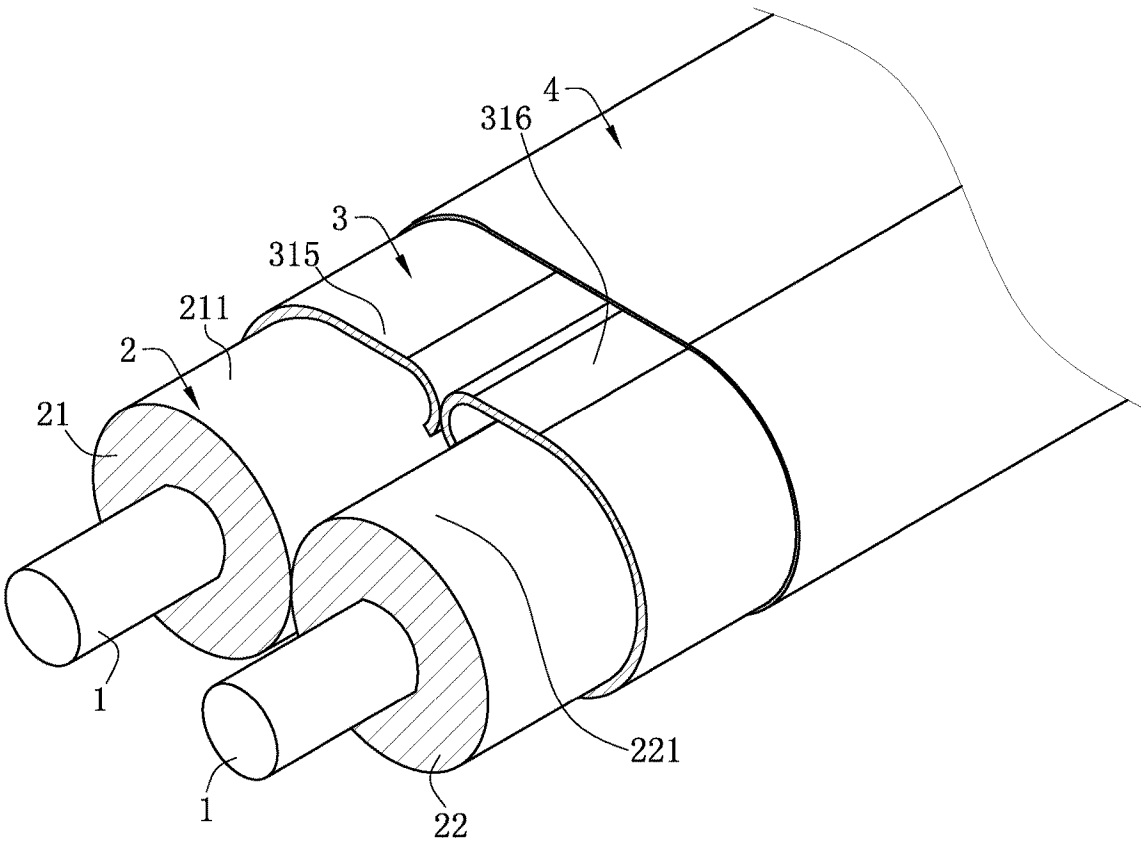
FIG. 3 is a schematic three-dimensional assembly view of the cable according to the first embodiment of the invention.

As shown in FIGS. 1-3, a cable 100 according to one embodiment of the invention includes two cores 1, and an insulator 2, a shielding sheet 3, and an insulation jacket 4 that sequentially, coaxially wrap around each of the cores 1 from inside to outside.

Figure 4:
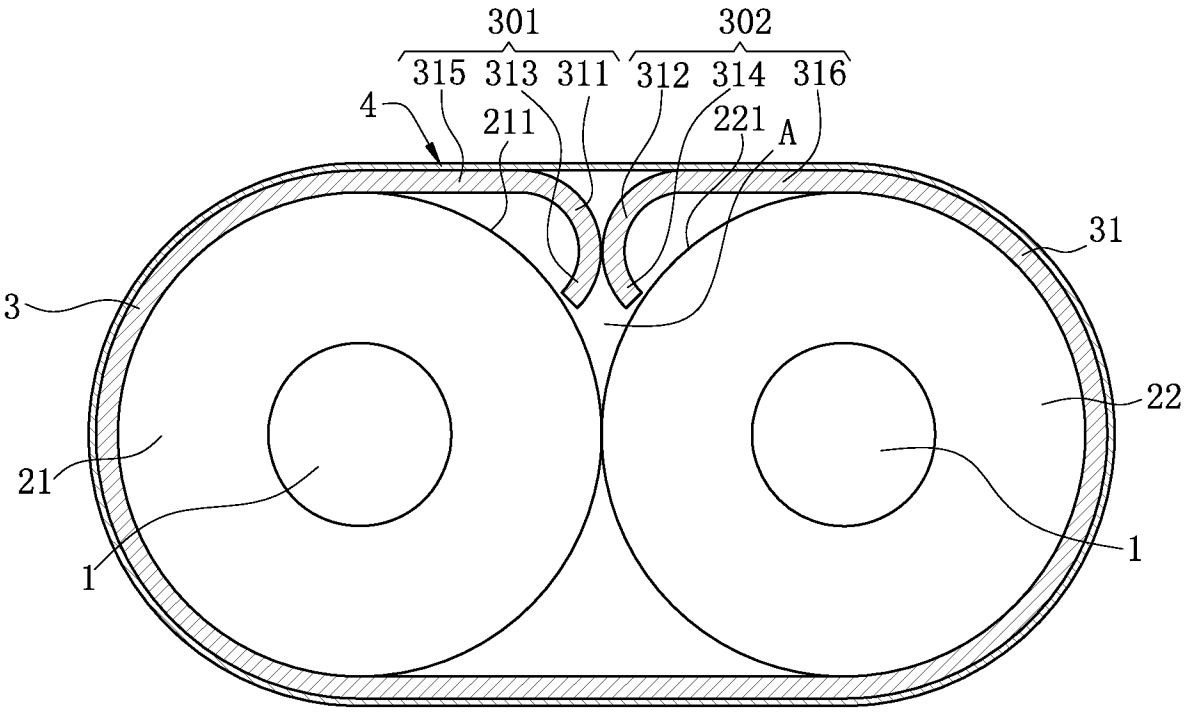
FIG. 4 is a cross-sectional view of the cable according to the first embodiment of the present invention.

FIGS. 2-4 illustrate a first embodiment of this invention. In this embodiment, the insulator 2 is a cylinder, and includes a first insulator 21 and a second insulator 22 arranged in parallel to the first insulator 21. The first and second insulators 21 and 22 have the same size and shape. The first insulator 21 has a first surface 211, the second insulator 22 has a second surface 221 urging against the first surface 211, and at least parts of the first surface 211 and the second surface 221 are not overlapped. In certain embodiments, each of the insulators 21 and 22 tightly wraps around at least one corresponding core 1, and the core 1 is located at a position of a central line of the cylindrical insulator 21 or 22. The cores 1 wrapped around by the first insulator 21 and the second insulator 22 construct a pair of differential signal terminals, to satisfy the requirement of high-speed signal transmission in the cable 100. In certain embodiments, the insulator 2 is made of polytetrafluoroethylene (PTFE), to meet the requirements of heat resistance and good insulation property. In other embodiments, the insulator 2 may also be made of other materials as long as the insulator 2 can isolate the core 1 and prevent short-circuiting of the core 1, and this invention is not limited thereto.

The shielding sheet 3 has a wrapping portion 31, and a first end portion 301 and a second end portion 302 that are located on two sides of the wrapping portion 31. The wrapping portion 31 longitudinally wraps around both the first insulator 21 and the second insulator 22 in the direction parallel to axes of the cores 1, to shield crosstalk during high-speed signal transmission in the cores 1. In other embodiments, the shielding sheet 3 may wrap three or more insulators 2, and this invention is not limited thereto. A space A is formed between the shielding sheet 3, the first surface 211, and the second surface 221. The first end portion 301 includes a first connecting section 315 formed by extending from one side of the wrapping portion 31 and a first bending section 311 formed by bending and extending from a tail end of the first connecting section 315. The second end portion 302 includes a second connecting section 316 formed by extending from the other side of the wrapping portion 31 and a second bending section 312 formed by bending and extending from a tail end of the second connecting section 316. The first bending section 311 and the second bending section 312 both enter the space A, to avoid overlapping of two side edges of the shielding sheet 3 on its surface, thereby guaranteeing evenness of the outer surface of the shielding sheet 3, improving the bending property of the shielding sheet 3, and preventing the shielding sheet 3 from being detached from the insulator 2 during bending of the cable 100. Further, the first bending section 311 urges against the second bending section 312, such that the shielding sheet 3 forms a closed chamber to wrap around the first insulator 21 and the second insulator 22, thereby enhancing the shielding effect thereof. The first bending section 311 and the second bending section 312 bend and extend in directions away from each other in the space A, to form a first extending section 313 and a second extending section 314, respectively. A combination of the first extending section 313 and the second extending section 314 presents an inverted V shape in the extending directions, to guide the first bending section 311 and the second bending section 312 to bend and enter the space A. In addition, a clearance is provided between the first extending section 313 and the first surface 211 and a clearance is provided between the second extending section 314 and the second surface 221, to prevent end edges of the shielding sheet 3 from interfering with the insulators 2, so as to enable the wrapping portion 31 to tightly adhere to the surfaces of the insulators 2. In this embodiment, the shielding sheet 3 is a membrane made of copper or aluminum. In other embodiments, the shielding sheet 3 may be soldered by any manner and be made of any material as long as a good effect of shielding crosstalk during signal transmission of the cores 1 can be achieved by using the shielding sheet 3, and this invention is not limited thereto.

As shown in FIG. 4, the shielding sheet 3 is further wrapped around by an insulation jacket 4. The insulation jacket 4 tightly fits with outer surfaces of the wrapping portion 31, the first connecting section 315, and the second connecting section 316, to prevent the shielding sheet 3 from being damaged. In certain embodiments, the insulation jacket 4 is a transparent plastic membrane, to facilitate observation of a wrapping situation of the shielding sheet 3 during use of the cable 100.

Figure 5:
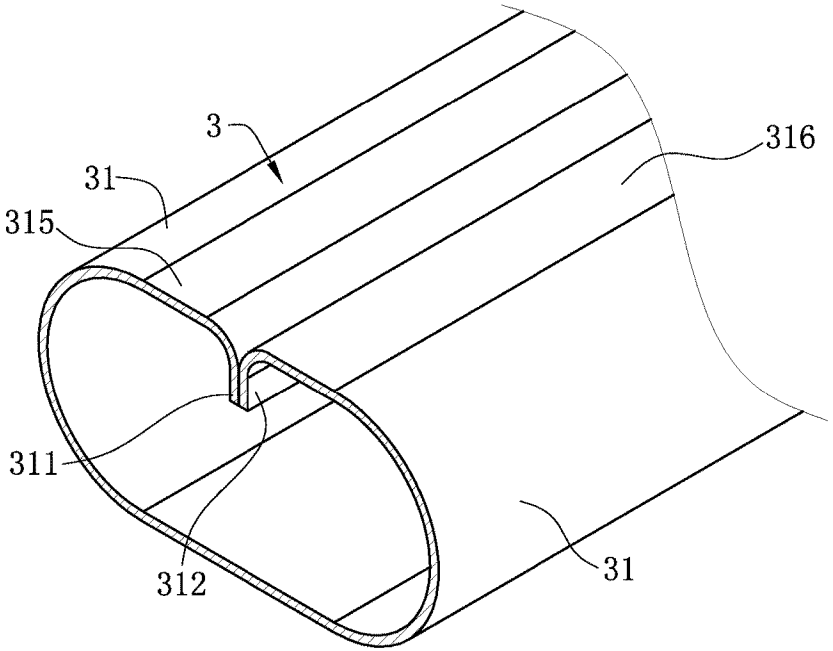
FIG. 5 is a schematic three-dimensional view of a shielding sheet of a cable according to a second embodiment of the present invention.
Figure 6:
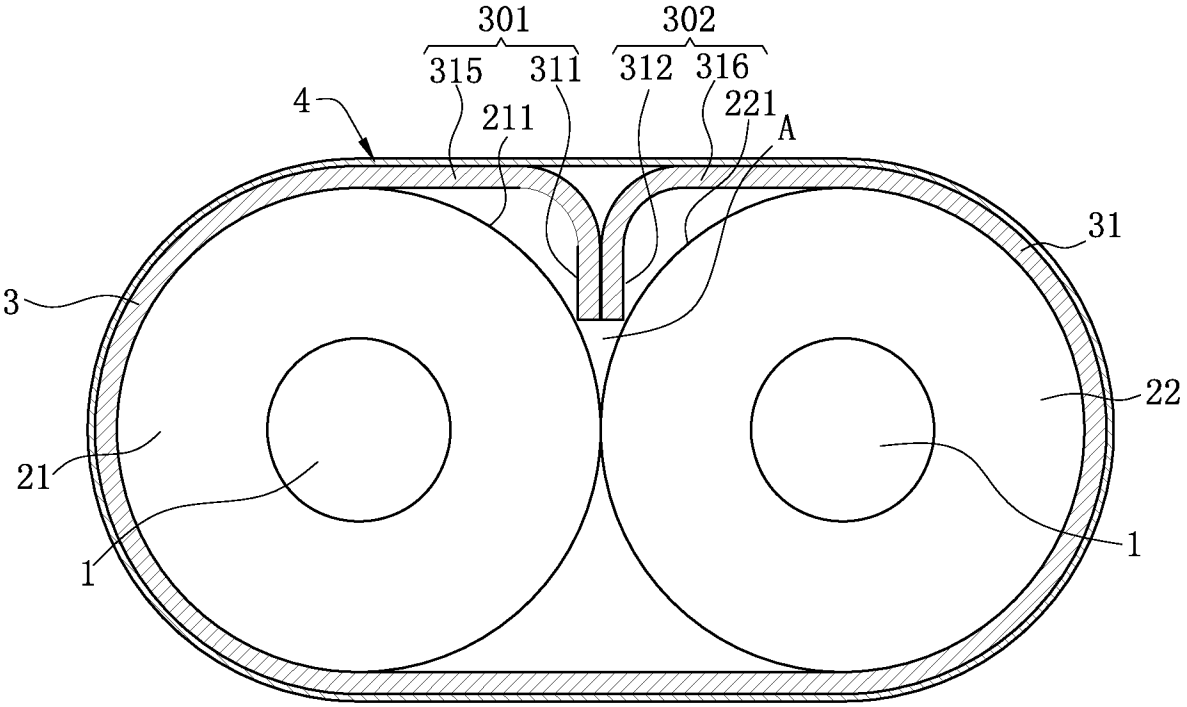
FIG. 6 is a cross-sectional view of the cable according to the second embodiment of the invention.

FIG. 5 and FIG. 6 illustrate a second embodiment of the cable 100 of this invention. This embodiment differs from the first embodiment in that: the first bending section 311 and the second bending section 312 are formed by vertically bending downward from tail ends of the first connecting section 315 and the second connecting section 316, respectively, and the two opposite surfaces of the first bending section 311 and the second bending section 312 are adhered to each other, such that the contact area between the first bending section 311 and the second bending section 312 is increased and the first bending section 311 and the second bending section 312 urge against each other more firmly. The other structures and functions of this embodiment are consistent with those of the first embodiment, which are not described again herein.

In summary, the cable 100 according to certain embodiments of this invention has the following beneficial advantages:

(1) The first end portion 301 and the second end portion 302 of the shielding sheet 3 bend and enter the space A, to avoid overlapping of two side edges of the shielding sheet 3 on its surface, thereby enabling the surface of the shielding sheet 3 to be even, guaranteeing the bending property of the shielding sheet 3, preventing the shielding sheet 3 from divorcing from the insulators 2 during bending of the cable 100, enhancing the shielding effect of the shielding sheet 3, and improving the stability of signal transmission of the cable 100.

(2) The first bending section 311 urges against the second bending section 312, such that the shielding sheet 3 forms a closed chamber to wrap around the first insulator 21 and the second insulator 22, thereby enhancing the shielding effect thereof.

(3) The first bending section 311 and the second bending section 312 are formed by vertically bending downwards from tail ends of the first connecting section 315 and the second connecting section 316, respectively, and the two opposite surfaces of the first bending section 311 and the second bending section 312 are adhered to each other, such that the contact area between the first bending section 311 and the second bending section 312 is increased and the first bending section 311 and the second bending section 312 abut against each other more firmly.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable, comprising:

at least two cores for transmitting signals;

a first insulator and a second insulator, each wrapping one of the at least two cores, wherein the first insulator has a first surface, the second insulator has a second surface urging against the first surface, and at least parts of the first surface and the second surface are not overlapped; and a shielding sheet comprising a wrapping portion, and a first end portion and a second end portion located on two sides of the wrapping portion, wherein the wrapping portion longitudinally wraps around both the first insulator and the second insulator in a direction parallel to axes of the at least two cores, such that a space is formed between the shielding sheet, the first surface, and the second surface, and the first end portion and the second end portion bend and enter the space;

wherein the first end portion comprises a first connecting section formed by extending from one side of the wrapping portion and a first bending section formed by bending and extending from a tail end of the first connecting section;

wherein the second end portion comprises a second connecting section formed by extending from the other side of the wrapping portion and a second bending section formed by bending and extending from a tail end of the second connecting section; and wherein the first bending section and the second bending section enter the space, and the first bending section and the second bending section bend and extend in directions away from each other in the space, to form a first extending section and a second extending section, respectively, and a combination of the first extending section and the second extending section presents an inverted V shape in the extending directions.

2. The cable of claim 1, wherein the first bending section urges against the second bending section.

3. The cable of claim 1, wherein the first insulator and the second insulator are cylinders having the same size and shape and are arranged parallel to each other, a clearance is provided between the first extending section and the first surface, and a clearance is provided between the second extending section and the second surface.

4. The cable of claim 1, wherein the first bending section and the second bending section are formed by vertically bending downwards from tail ends of the first connecting section and the second connecting section, respectively, and the two opposite surfaces of the first bending section and the second bending section are adhered to each other.

5. The cable of claim 1, wherein the shielding sheet is further wrapped around by an insulation jacket, the insulation jacket tightly fits with the wrapping portion, the first connecting section, and the second connecting section, and clearances are provided between the insulation jacket and the first bending section and between the insulation jacket and the second bending section, respectively.

6. The cable of claim 5, wherein the insulation jacket is a transparent plastic membrane.

7. The cable of claim 1, wherein the shielding sheet is a membrane made of copper or aluminum.

8. The cable of claim 7, wherein the shielding sheet has an even thickness.

* * * * *